US007290979B2

(12) United States Patent
Koyama et al.

(10) Patent No.: US 7,290,979 B2
(45) Date of Patent: Nov. 6, 2007

(54) CIRCUMFERENTIAL FLOW PUMP

(75) Inventors: Masahiro Koyama, Tokyo (JP); Yuusaku Sakai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/099,497

(22) Filed: Apr. 6, 2005

(65) Prior Publication Data

US 2006/0120852 A1 Jun. 8, 2006

(30) Foreign Application Priority Data

Dec. 3, 2004 (JP) ..... P2004-351259

(51) Int. Cl.
*F04D 5/00* (2006.01)

(52) U.S. Cl. ..... 415/55.1; 417/423.3

(58) Field of Classification Search ..... 416/180, 416/184, 198 R, 203; 417/423.3; 415/55.1, 415/55.2, 55.3, 55.4, 55.5, 55.6, 55.7
See application file for complete search history.

(56) References Cited

U.S. PATENT DOCUMENTS 4,403,910 A * 9/1983 Watanabe et al. ..... 415/55.1
5,328,325 A 7/1994 Strohl et al.
5,464,319 A * 11/1995 Liskow ..... 415/55.1
6,174,128 B1 * 1/2001 Yu ..... 415/55.2
6,422,808 B1 * 7/2002 Moss et al. ..... 415/55.1
6,443,692 B1 * 9/2002 Sakamoto et al. ..... 415/55.1
2006/0008344 A1 * 1/2006 Ando et al. ..... 415/55.1

FOREIGN PATENT DOCUMENTS

JP 04031660 A * 2/1992

* cited by examiner

*Primary Examiner*—Richard A. Edgar
(74) *Attorney, Agent, or Firm*—Sughrue Mion Pllc.

(57) ABSTRACT

In a circumferential flow pump, a first groove sectional area (S1) of a feed passage at a pump cover side is set to be smaller than a second groove sectional area (S2) of a feed passage at a pump base side, whereby the diameter of an eddy flow occurring in the first groove sectional area (S1) is smaller than the diameter of an eddy flow occurring in the second groove sectional area (S2). Therefore, the fuel pressure of the feed passage at the pump cover side is set to be higher than that of the feed passage at the pump base side, and thus a vane wheel is formed to be pressed against the pump base side.

2 Claims, 4 Drawing Sheets

CIRCUMFERENTIAL FLOW PUMP

BACKGROUND OF THE INVENTION

1. Field of the Invention

The present invention relates to a circumferential flow pump which is accommodated in a fuel tank of a vehicle to press-feed fuel to an internal combustion engine, for example.

2. Description of the Related Art

A conventional circumferential flow pump is designed so that the groove cross-section area of an annular feed passage disposed in a pump cover and the groove cross-section area of an annular feed passage disposed in a pump base are set to be substantially equal to each other, and the dimension of a space formed in a vane wheel so as to confront the feed passage of the pump cover and the dimension of a space formed in the vane wheel so as to confront the feed passage-of the pump base are set to be substantially equal to each other, whereby the pressure balance in a pump chamber formed by the pump cover, the pump base and the vane wheel is made uniform as disclosed in Japanese Patent No. 2,962,828 (Patent Document 1).

In the conventional circumferential flow pump thus constructed, when fuel press-fed from the circumferential flow pump to the internal combustion engine is reduced, the pressure in the neighborhood of a discharge port of the pump base is increased and force acts on the vane wheel so that the vane wheel is pressed against the pump cover side. Therefore, the vane wheel is inclined and thus rotated while coming into contact with the pump cover or the pump base, so that the sliding resistance thereof is increased and the operating current of an electrically-driven motor for rotating the vane wheel is increased. In addition, the discharge amount is reduced, and the fuel press-fed from the circumferential flow pump to the internal combustion engine is reduced.

SUMMARY OF THE INVENTION

The present invention has been implemented to solve the above problem, and has an object to provide an efficient circumferential flow pump for press-feeding fuel to an internal combustion engine in which even when the pressure of fuel press-fed from the circumferential flow pump to the internal combustion engine is increased, the fuel press-fed from the circumferential flow pump to the internal combustion engine is prevented from being reduced.

In order to attain the above object, according to a first aspect of the present invention, a circumferential flow pump which press-feeds fuel and is equipped with a pump cover and a pump base constituting a pump chamber and a disc-shaped vane wheel rotating in the pump chamber and in which plural vane groove portions are formed along the outer peripheral wall of the vane wheel so as to penetrate through the vane wheel and so as to be trained in the outer peripheral direction of the vane wheel while partitioned by partition walls in the outer peripheral direction, and feed passages are formed in an annular form in the pump cover and the pump base respectively so as to face the vane groove portions of the vane wheel, is characterized in that a first groove sectional area (S1) of the feed passage at the pump cover side is set to be smaller than a second groove sectional area (S2) of the feed passage at the pump base side.

Furthermore, according to a second aspect of the present invention, a circumferential flow pump which press-feeds fuel and is equipped with a pump cover and a pump base constituting a pump chamber and a disc-shaped vane wheel rotating in the pump chamber and in which plural vane groove portions are formed along the outer peripheral wall of the vane wheel so as to penetrate through the vane wheel and so as to be trained in the outer peripheral direction of the vane wheel while partitioned by partition walls in the outer peripheral direction, and feed passages are formed in an annular form in the pump cover and the pump base respectively so as to face the vane groove portions of the vane wheel, is characterized in that a first spatial dimension (L1) formed in the vane wheel so as to confront the feed passage at the pump cover side is set to be smaller than a second spatial dimension (L2) formed in the vane wheel so as to confront the feed passage at the pump base side.

According to the present invention, in such a case that the fuel press-fed from the circumferential flow pump to an internal combustion engine is reduced, when the pressure of the fuel in the neighborhood of a discharge port of the pump base is increased, the pressure thus increased is balanced with the force for pressing the vane wheel to the pump cover side, and thus the vane wheel is not inclined. Therefore, the vane wheel is rotated with no occurrence of high sliding resistance between the pump base and the pump cover, so that the efficiency of the circumferential flow pump can be enhanced.

DETAILED DESCRIPTION OF THE PREFERRED EMBODIMENTS

Preferred embodiments according to the present invention will be described hereunder with reference to the accompanying drawings.

First Embodiment

Figure 1:
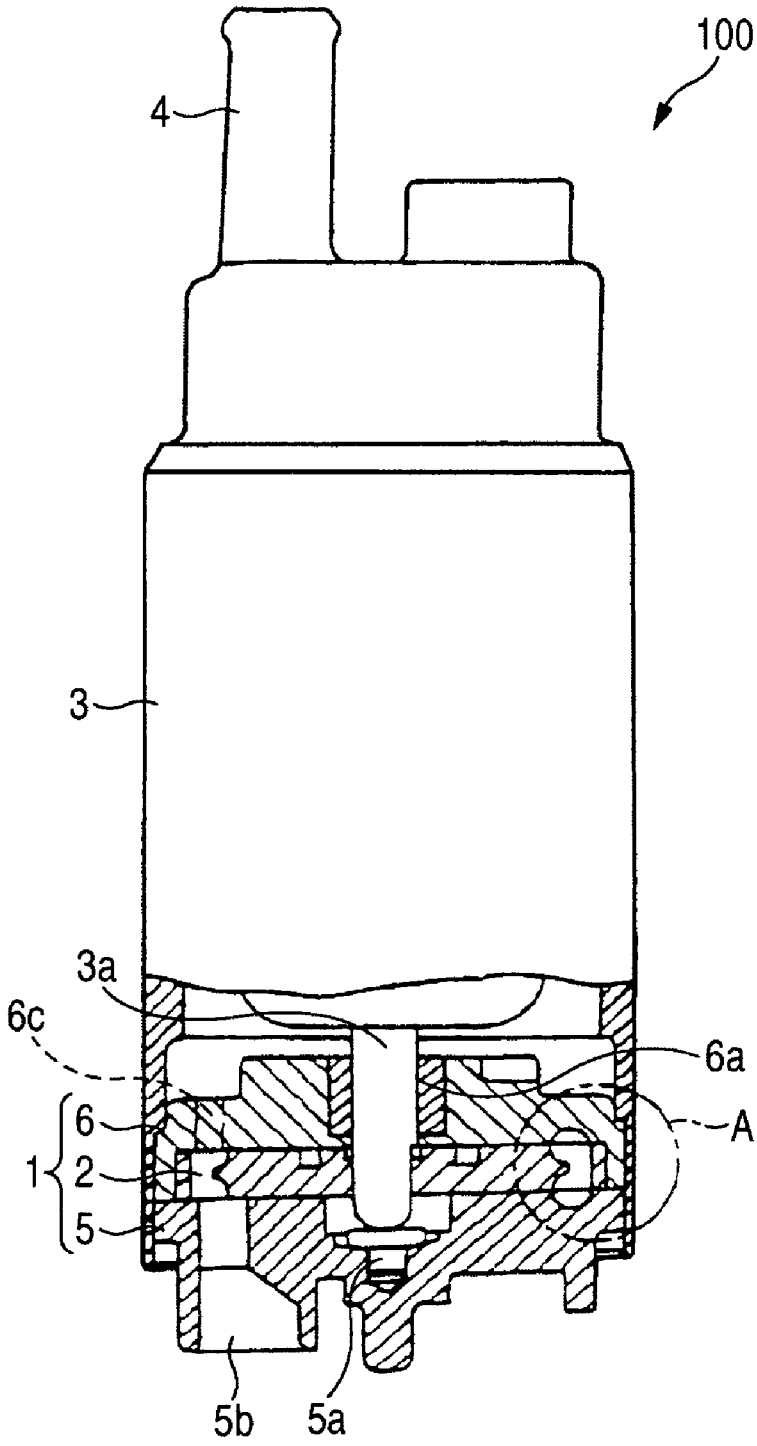
FIG. 1 is a partial longitudinally sectional view showing a fuel supply device having a circumferential flow pump according to a first embodiment of the present invention.
Figure 2:
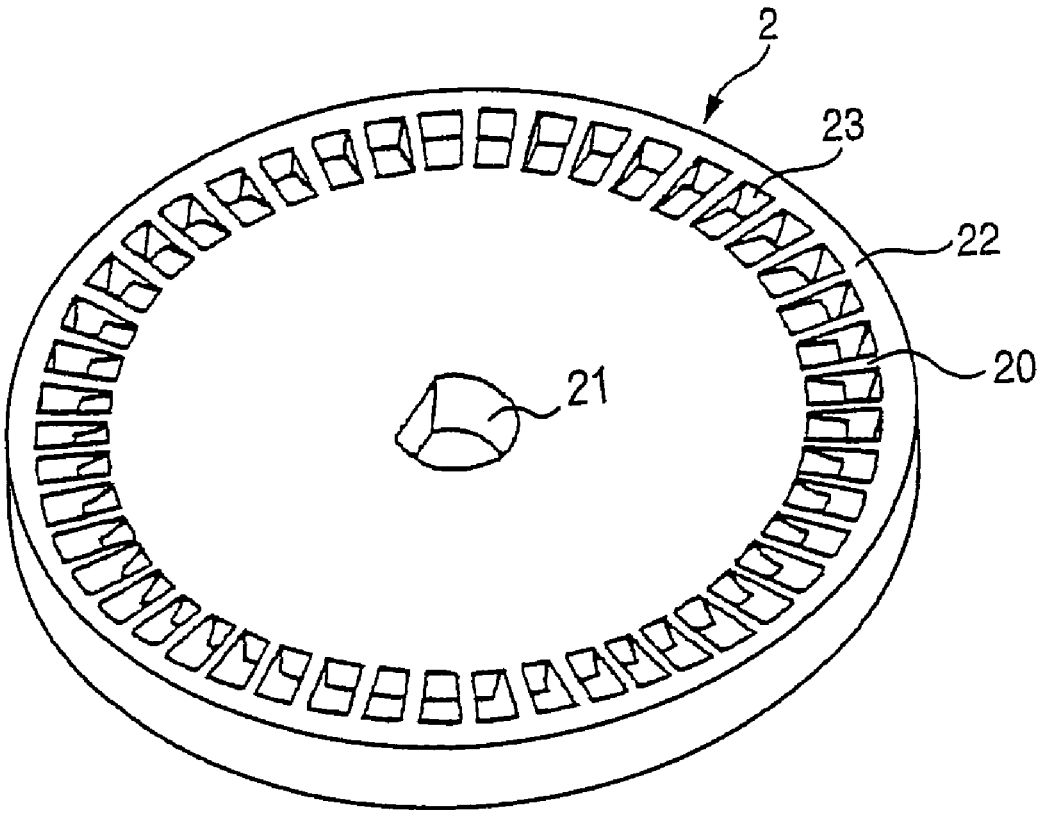
FIG. 2 is an enlarged perspective view showing the outlook of a vane wheel constituting the circumferential flow pump of FIG. 1.
Figure 3:
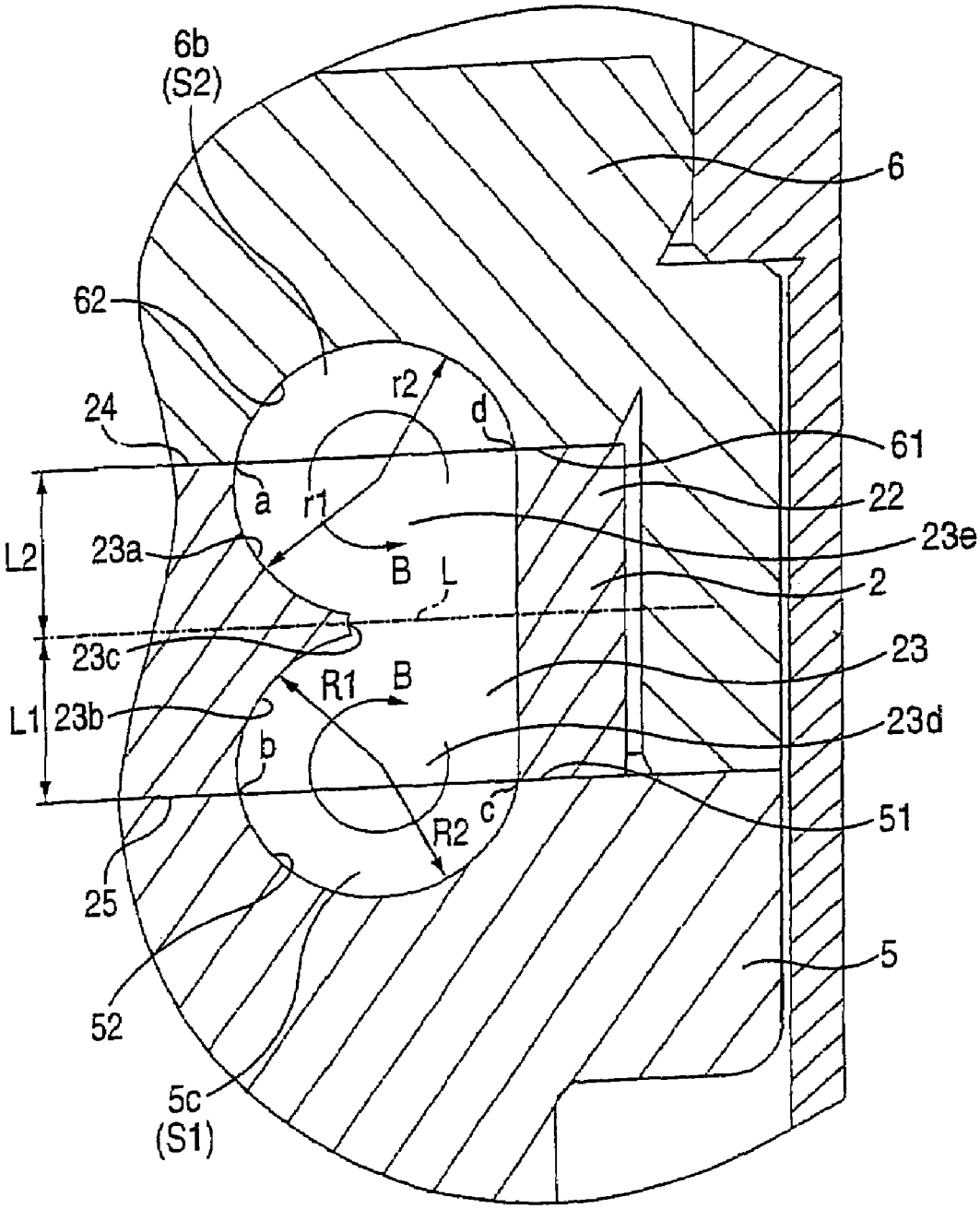
FIG. 3 is an enlarged longitudinally sectional view showing the main part of the circumferential flow pump of FIG. 1.
Figure 4:
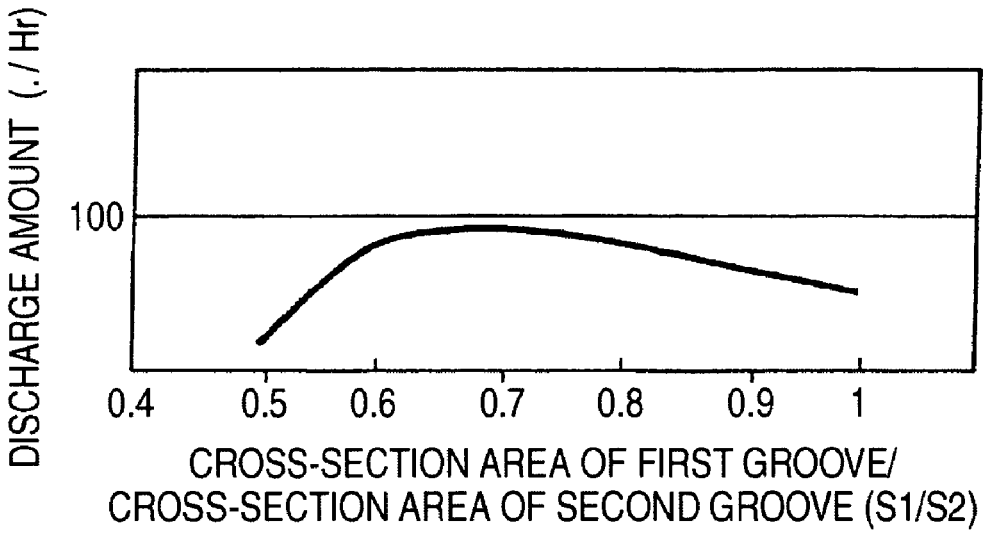
FIG. 4 is a characteristic diagram showing the relationship of a discharge amount with a groove sectional area ratio of a feed passage of the circumferential flow pump of FIG. 1.

FIG. 1 is a partial longitudinally sectional view showing a fuel supply device having a circumferential flow pump according to a first embodiment of the present invention, FIG. 2 is an enlarge perspective view showing a vane wheel constituting the circumferential flow pump of FIG. 1, FIG. 3 is an enlarged longitudinally-sectional view showing the main part of the circumferential flow pump of FIG. 1, and FIG. 4 is a characteristic diagram showing the relationship of a discharge amount with a groove sectional area ratio of a feed passage of the circumferential pump of FIG. 1.

In FIG. 1, for example, a fuel supply device 100 for supplying fuel to an internal combustion engine of a vehicle comprises a circumferential flow pump 1, an electrically-driven motor 3 for driving the circumferential flow pump 1, and a discharge port 4 through which the fuel discharged from the circumferential flow pump 1 is fed out to an internal combustion engine. The circumferential pump 1 comprises a vane wheel 2 coupled to a shaft 3*a* joined to the electrically-driven motor 3, a pump cover 5 for accommodating the vane wheel 2 and a pump base 6.

A thrust block 5*a* for supporting the movement of the shaft 3*a* the electrically-driven motor 3 in the thrust direction and a suction port 5*b* for introducing fuel (not shown) to the vane wheel 2 are disposed at the center portion of the pump cover 5, and a metal 6*a* for supporting the rotation of the shaft 3*a* is disposed at the center portion of the pump base 6.

In FIGS. 2 and 3, the vane wheel 2 is designed to have a disc shape, and an engaging portion 21 which is formed to have a D-shape and engageable with the shaft 3*a* is formed at the center portion of the vane wheel 2. Furthermore, an annular outer peripheral wall 22 is formed on the outer peripheral portion of the vane wheel 2. Plural vane groove portions 23 are formed along the outer peripheral wall 22 so as to penetrate through the vane wheel 2 and so as to be trained in the outer peripheral direction of the vane wheel 2 while partitioned by partition walls 20 in the outer peripheral direction as shown in FIG. 2. Furthermore, feed passages 5*c* and 6*b* are formed in an annular form in the pump cover 5 and the pump base 6 respectively so as to face the vane groove portions 23 of the vane wheel 2.

As shown in FIG. 3, each vane groove portion 23 comprises a first circular bow portion 23*a* formed so as to extend from a cross-point a of the end face 24 of the vane wheel 2 with a radius of r1, and a second circular bow portion 23*b* formed so as to extend from a cross-point b of the end face 25 of the vane wheel 2 with a radius of R1. The first circular bow portion 23*a* and the second circular bow portion 23*b* are joined through a joint face 23*c* to each other at substantially the intermediate position in the axial direction of the vane wheel 2 (in the vertical direction of FIG. 3).

Here, the position of the joint face 23*c* is set as a center line L, the distance from the end face 24 of the vane wheel 2 to the center line L is represented by L2, the distance from the end face 25 of the vane wheel 2 to the center line L is represented by L1, the space surrounded by the end face 25, the second circular bow portion 23*b*, the center line L and the outer peripheral wall 22 is set as a first space 23*d*, and the space surrounded by the end face 24, the first circular bow portion 23*a*, the center line L and the outer peripheral portion 22 is set as a second space 23*e*.

Furthermore, the feed passage 5*c* is formed by a first annular portion 52 formed so as to extend from a cross-point c of the end face of the cover end face 51 of the pump cover 5 with a radius of R2, and the feed passage 6*b* is formed by a second annular portion 62 formed so as to extend from a cross-point d of the base end face 61 of the pump base 6 with a radius of r2. The feed passage 5*c* at the pump cover side is set to a first groove cross section (S1), and the feed passage 6*b* at the pump base side is set to a second groove cross section (S2).

The operation of the circumferential flow pump 1 according to the present invention thus constructed will be described.

(1) When the fuel supply device 100 is immersed in a fuel tank (not shown), fuel flows through the suction port 5*b* into the vane groove portions 23.

(2) When power is supplied to the electrically-driven motor 3, the electrically-driven motor 3 is rotated, and thus the vane wheel 2 coupled to the shaft 3*a* of the electrically-driven motor 3 is rotated.

(3) When the vane wheel 2 is rotated, the vane wheel groove portions 23 are rotationally moved in the feed passage 5*a* and the feed passage 6*a*, whereby two eddy flows (indicated by arrows B of FIG. 3) occur in the fuel.

(4) The kinetic energy of each of the eddy flows B is gradually more and more increased as the vane wheel 2 is rotated, and thus the fuel in the vane groove portions 23 is increased in pressure, so that the fuel thus pressure-increased is passed through the electrically-driven motor 3 and discharged from the discharge port 4, and then supplied to the internal combustion engine (not shown).

In the circumferential flow pump 1 according to the first embodiment, the first groove sectional area (S1) of the feed passage 5*c* at the pump cover 5 side is set to be smaller than the second groove sectional area (S2) of the feed passage 6*b* at the pump base 6 side, and thus the diameter of the eddy flow occurring in the first groove sectional area (S1) due to the rotation of the vane wheel 2 is smaller than the diameter of the eddy flow of the second groove sectional area (S2). Therefore, the flow rate of the eddy flow is increased, and the fuel pressure of the feed passage 5*c* at the pump cover 5 side is higher than that of the feed passage 6*b* at the pump base 6 side, and the vane wheel 2 is forced to be pressed to the pump base 6 side at all times. Accordingly, in such a case that the fuel press-fed from the circumferential flow pump 1 through the discharge port 4 to the internal combustion engine (not shown) is reduced, when the pressure in the neighborhood of the discharge port 6*c* of the pump base 6 is increased, the pressure thus increased is balanced with the force pressing the vane wheel 2 to the pump cover 5 side, and thus the vane wheel 2 is not inclined. Therefore, the vane wheel 2 is rotated with no occurrence of high sliding resistance between the pump base 6 and the pump cover 5, so that the efficiency of the circumferential flow pump can be enhanced.

FIG. 4 shows an experiment result achieved by the inventor of this application, and more specifically FIG. 4 is a graph showing the relationship between the discharge amount of fuel discharged from the discharge port 4 and the ratio of the first groove sectional area (S1) and the second groove sectional area (S2) when the power supplied to the fuel supply device 100 is fixed (voltage of 12V, current of 3 A) and the fuel pressure discharged from the discharge port 4 is fixed (3.3 atm). The discharge amount is larger for $0.6 \leqq S1/S2 < 0.9$, and the efficiency of the circumferential flow pump is excellent.

Second Embodiment

A circumferential flow pump 1 according to a second embodiment of the present invention is designed so that the first spatial dimension (L1) formed in the vane wheel 2 so as to confront the feed passage 5*c* at the pump cover 5 side is smaller than the second spatial dimension (L2) formed in the vane wheel 2 so as to confront the feed passage 6*b* at the pump base 6 side in FIG. 3 instead of making the first groove sectional area (S1) of the feed passage 5*c* at the pump cover 5 side smaller than the second groove sectional area (S2) of the feed passage 6*b* at the pump base 6 side.

In the circumferential flow pump 1 according to the second embodiment thus constructed, the first spatial dimension (L1) formed in the vane wheel 2 so as to confront the feed passage 5*c* at the pump cover 5 side is smaller than the second spatial dimension (L2) formed in the vane wheel 2 so as to confront the feed passage 6*b* at the pump base 6 side, so that the diameter of the eddy flow occurring in the first space 23*d* is smaller than the diameter of the eddy flow occurring in the second space 23*e*. Therefore, the flow rate of the eddy flow in the first space 23*d* is increased, the fuel pressure of the feed passage 5*c* at the pump cover 5 side is higher than that of the feed passage 6*b* at the pump base 6 side, and the vane wheel 2 is forced to be pressed to the pump base 6 side at all times. Accordingly, in such a case where the fuel press-fed from the circumferential flow pump 1 through the discharge port 4 to the internal combustion engine (not shown) is reduced, when the pressure in the neighborhood of the discharge port 6*c* of the pump base 6 is increased, the increased pressure is balanced with the force for pressing the vane wheel 2 to the pump cover 5 side. Therefore, the vane wheel 2 is not inclined, and the it is rotated with no occurrence of high sliding resistance between the pump base 6 and the pump cover 5, whereby the efficiency of the circumferential flow pump is enhanced.

Figure 5:
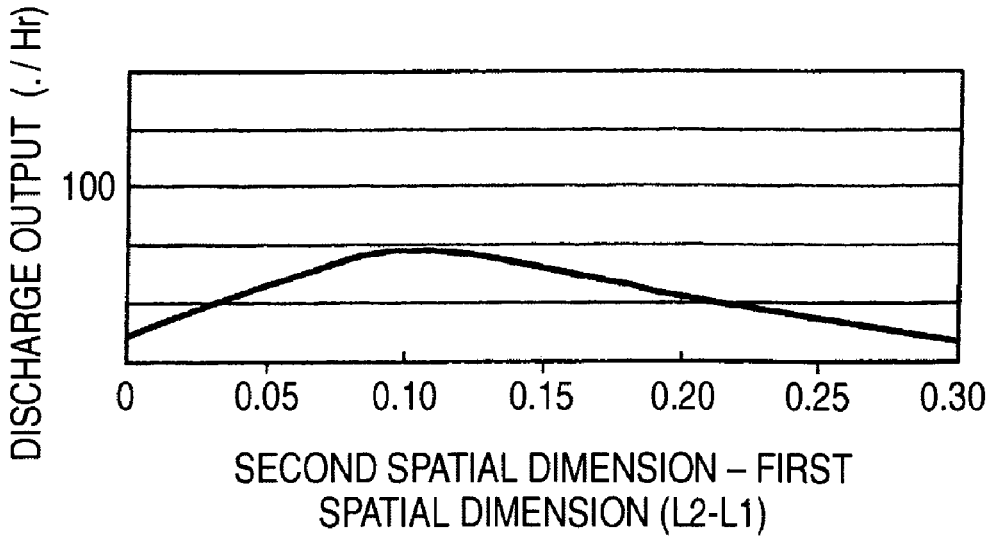
FIG. 5 is a characteristic diagram showing the relationship of a discharge amount with a spatial dimension ratio of the vane wheel of the circumferential flow pump according to a second embodiment of the present invention.

FIG. 5 shows an experiment result achieved by the inventor of this application, and more specifically FIG. 5 is a graph showing the relationship between the discharge amount of fuel discharged from the discharge port 4 and the difference between the first spatial dimension (L1) and the second spatial dimension (L2) when the power (voltage× current) supplied to the fuel supply device 100 and the pressure of the fuel discharged from the discharge port 4 are fixed. The discharge amount is larger for $0.05<L2-L1\leqq 0.20$, and the efficiency of the circumferential flow pump is excellent.

What is claimed is:

1. A circumferential flow pump which press-feeds fuel and is equipped with a pump cover and a pump base constituting a pump chamber and a disc-shaped vane wheel rotating in the pump chamber and in which plural vane groove portions are formed along an outer peripheral wall of the vane wheel so as to penetrate through the vane wheel and so as to be trained in an outer peripheral direction of the vane wheel while partitioned by partition walls in the outer peripheral direction, and feed passages are formed in an annular form in the pump cover and the pump base respectively so as to face the vane groove portions of the vane wheel, wherein a first groove sectional area (S1) of a feed passage at a pump cover side is set to be smaller than a second groove sectional area (S2) of a feed passage at a pump base side, wherein an annular outer peripheral wall is formed on the outer peripheral portion of said disc-shaped vane wheel, wherein the ratio of the first groove sectional area (S1) and the second groove sectional area (S2) is set to satisfy $0.6\leqq S1/S2<0.9$.

2. A circumferential flow pump which press-feeds fuel and is equipped with a suction side of said circumferential flow pump and a discharge side of said circumferential flow pump and having a pump chamber and a disc-shaped vane wheel rotating in the pump chamber and in which plural vane groove portions are formed along an outer peripheral wall of the vane wheel so as to penetrate through the vane wheel and so as to be trained in an outer peripheral direction of the vane wheel while partitioned by partition walls in the outer peripheral direction, and feed passages are formed in an annular form on a discharge side and a suction side of the pump chamber so as to face the vane groove portions of the vane wheel, wherein a first groove sectional area (S1) of a feed passage at the suction side is set to be smaller than an axially adjacent second groove sectional area (S2) of a feed passage at the discharge side, wherein the ratio of the first groove sectional area (S1) and the second groove sectional area (S2) is set to satisfy $0.6\leqq S1/S2<0.9$.

* * * * *